United States Patent [19]

Ochiai et al.

[11] Patent Number: 4,919,734

[45] Date of Patent: Apr. 24, 1990

[54] COMPRESSED MAGNETIC POWDER CORE

[75] Inventors: Kumi Ochiai, Yokohama; Hiromichi Horie, Yokosuka; Itsuo Arima, Kawasaki; Mikio Morita, Yokohama, all of Japan

[73] Assignee: Kabushiki Kaisha Toshiba, Kawasaki, Japan

[21] Appl. No.: 97,402

[22] Filed: Sep. 14, 1987

Related U.S. Application Data

[63] Continuation of Ser. No. 780,303, Sep. 26, 1985, abandoned.

[30] Foreign Application Priority Data

Sep. 29, 1984 [JP] Japan ..... 59-204870
Dec. 27, 1984 [JP] Japan ..... 59-274096

[51] Int. Cl.[5] ..... H01F 1/04

[52] U.S. Cl. ..... 148/306; 75/230; 75/232; 75/235

[58] Field of Search ..... 148/306; 75/230, 232, 75/235

[56] References Cited

U.S. PATENT DOCUMENTS

| | | | |
|---|---|---|---|
| Re. 20,507 | 9/1937 | Andrews et al. | 148/31.55 |
| 1,651,958 | 12/1927 | Lowry | 148/31.55 |
| 1,669,642 | 5/1928 | Andrews | 148/31.55 |
| 1,901,018 | 3/1933 | Bieber | 148/31.55 |
| 1,981,468 | 11/1934 | Roseby | 148/31.55 |
| 2,864,734 | 12/1958 | Adams et al. | 148/31.55 |
| 2,873,225 | 2/1959 | Adams et al. | 148/31.55 |
| 2,977,263 | 3/1961 | Harendza-Harinxmce | 148/31.55 |
| 3,695,945 | 10/1972 | Benz | 148/31.57 |
| 3,877,999 | 4/1975 | Lerman et al. | 148/105 |
| 4,158,561 | 6/1979 | Pavlik et al. | 75/0.5 BA |
| 4,265,681 | 5/1981 | Krause et al. | 148/111 |

FOREIGN PATENT DOCUMENTS

| | | | |
|---|---|---|---|
| 3422281 | 12/1984 | Fed. Rep. of Germany | 148/31.55 |
| 47-22514 | 6/1972 | Japan . | |
| 60-26603 | 2/1985 | Japan | 148/31.55 |

*Primary Examiner*—John P. Sheehan
*Attorney, Agent, or Firm*—Oblon, Spivak, McClelland, Maier & Neustadt

[57] ABSTRACT

A compressed powder core is made of a compressed body of a magnetic powder each particle of which has a surface covered with an insulating layer. The insulating layer is formed of an insulating material selected from the group consisting of an inorganic compound powder having an electronegativity of not less than 12.5, an inorganic compound powder having an electronegativity of less than 8.5, a metal alkoxide and a decomposition product of a metal alkoxide.

3 Claims, 2 Drawing Sheets

COMPRESSED MAGNETIC POWDER CORE

This application is a continuation of Ser. No. 780,303, filed on Sept. 26, 1985, now abandoned.

BACKGROUND OF THE INVENTION

1. Field of the Invention

The present invention relates to a compressed magnetic powder core and, more particularly, to a powder core having a high magnetic flux density and good frequency characteristics of magnetic permeability.

2. Description of the Prior Art

Semiconductor switching elements (e.g., thyristors and transistors), turn-on stress buffer reactors, commutating reactors, energy storage reactors or matching transformers have been used as conventional electrical elements in power transformers (e.g., AC/DC converters, DC/DC converters such as choppers, and AC/AC frequency converters) or in electrical equipment such as noncontact switches.

Such conventional reactors and voltage transformers require an iron core having good magnetic characteristics in a high-frequency range.

Currents having switching frequencies of either several tens of Hz to 200 kHz or several tens of kHz or 500 kHz or more, often flow in conventional reactors and voltage transformers. Therefore, demand has arisen for an iron core which has a low iron loss and whose magnetic permeability is not reduced in a high-frequency range.

An eddy current loss among iron loss components in AC excitation of an iron core increases proportionally to the square of frequency when a magnetic flux density remains the same. Most of the iron loss is accounted for by the eddy current loss in the high-frequency range. As a result, the iron loss is increased and the magnetic permeability is decreased in the high-frequency range.

In a conventional iron core made of a metallic magnetic powder, a decrease in iron loss is achieved by improvement of electrical insulation between the magnetic particles.

Typical conventional iron cores having good high-frequency characteristics are exemplified by so-called dust cores as described in Japanese Patent Nos. 88779 and 112,235.

Although such dust cores have good high-frequency characteristics, their magnetic flux density is low. For example, a maximum magnetic flux density at a magnetizing force of 10000 A/m is only 0.125 T.

In another conventional iron core having a metallic magnetic powder and a binder resin as disclosed in Japanese Patent No. 670,518, good frequency characteristics and a high magnetic flux density can be obtained.

Generally, in the iron core manufactured by compression molding a metallic magnetic powder, magnetostriction caused by compression increases a coercive force as compared with that prior to compression. In addition, a hysteresis loss is increased accordingly.

In order to obtain a low-loss iron core, magnetostriction must be eliminated. For this purpose, a heat treatment (annealing) is normally performed to effectively eliminate such magnetostriction. In the iron core having the binder resin, however, the resin is decomposed or degraded during the heat treatment, and electrical insulation between the metal magnetic particles cannot be guaranteed. It is thus difficult to manufacture an iron core having a low iron loss.

SUMMARY OF THE INVENTION

It is, therefore, an object of the present invention to provide a compressed magnetic powder core which has a high magnetic flux density, good frequency characteristics of magnetic permeability, and a low hysteresis loss due to annealing.

In order to achieve the above object of the present invention, there is provided a compressed magnetic powder core comprising a compressed body of a metallic magnetic powder each particle of which has its surface covered with an insulating layer comprising an insulating material selected from the group consisting of an inorganic powder having an electronegativity of not less than 12.5, an inorganic powder having an electronegativity of less than 8.5, a metal alkoxide and a decomposition product of a metal alkoxide.

DESCRIPTION OF THE PREFERRED EMBODIMENT

Figure 1:
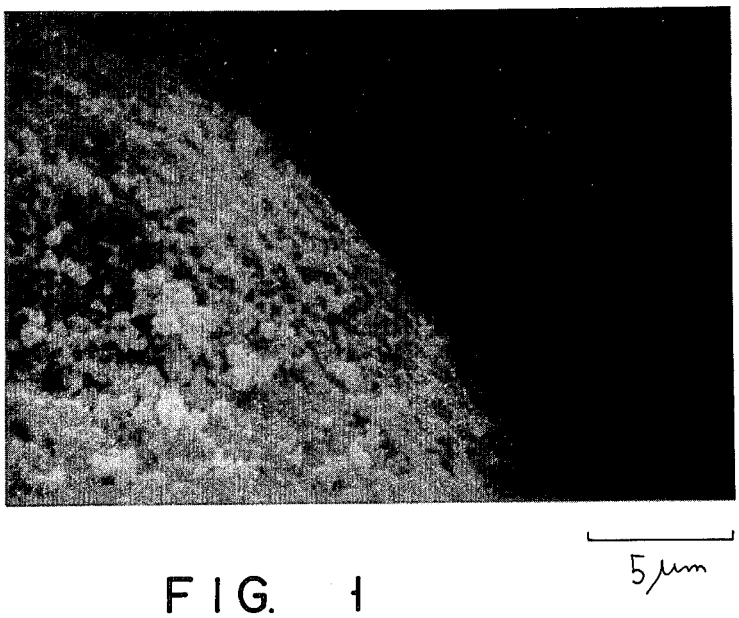
FIG. 1 is a photograph showing a state wherein an insulating inorganic compound is deposited on the surface of each magnetic powder particle according to the present invention.

A compressed magnetic powder core of the present invention is obtained by compressing a metallic magnetic powder, each particle of which is covered with an insulating layer of a specific insulating material. The metallic magnetic powder used in the present invention is preferably an iron-based magnetic powder such as pure iron, an iron-silicon alloy (e.g., Fe-3% Si) powder, an iron-aluminum alloy powder, an iron-nickel alloy powder, an iron-cobalt alloy powder, or an iron-containing amorphous alloy (e.g., an alloy containing iron and at least one of silicon, boron and carbon as a major component). One or a mixture of at least two of these magnetic powders can be used.

These metallic magnetic powders have a resistivity of 10 $\mu\Omega$ cm to several tens of $\mu\Omega$ cm. In order to obtain good core material properties for an AC current including one of high frequency giving rise to the skin effect, the magnetic powder must consist of microparticles so as to sufficiently be magnetized from surfaces to centers thereof.

For example, in a magnetic powder core which is to be excited by a current having a frequency component of several tens of kHz and which must have satisfactory permeability characteristics up to this frequency component, an average particle size is preferably 300 $\mu$m or less.

In a magnetic powder core to be excited in a frequency range of 100 kHz or more, an average particle size is preferably 100 $\mu$m or less.

When the average particle size of the magnetic powder is smaller than 10 $\mu$m, a satisfactory density of the core cannot be obtained at a normal pressure of 1,000

MPa or less. As a result, the magnetic flux density is low. The average particle size is preferably 10 μm or more.

The magnetic powder can be used as it is or after a natural oxide layer of several tens of nm which is formed on the surface of each particle in air is reduced. This reduction is performed by heating the powder in, for example, a hydrogen atmosphere.

Each particle of the magnetic powder used in the present invention is covered with an insulating layer of a specific insulating material. The insulating material is selected from the following inorganic compound which has a specific electronegativity, metal alkoxide or decomposition product of the metal alkoxide.

Inorganic Compound Powder

An insulating inorganic compound powder used in the present invention has an electronegativity of 12.5 or more, or less than 8.5, and has a particle form.

An electronegativity Xi of an inorganic compound containing metal ions can be calculated from Pauling's electronegativity Xo of inorganic ions as follows:

$$Xi=(1+2Z)Xo$$

where Z is the valence of the inorganic ion.

The electronegativity and charge upon contact with iron have a correlation (Oguchi and Tamatani, Institute of Static Electrocity Vol. 7, No. 5 (1983), P. 292 et seq). An inorganic compound having an electronegativity sufficiently larger than or smaller than that of iron is strongly attracted by an electrostatic force to the surface of the metallic, magnetic powder such as iron or iron alloy powder. Based on this fact, the present inventors found that an inorganic insulating compound having an electronegativity less than 8.5 or not less than 12.5 was strongly attached to the surface of the magnetic powder, and the deposited powder layer could sufficiently insulate each two adjacent particles of the magnetic powder, thereby obtaining a core material for achieving the prescribed object.

An inorganic insulating compound used in the present invention can be an inorganic oxide, an inorganic nitride or an inorganic carbide. Typical examples of inorganic compounds having an electronegativity of 12.5 or more are thallium oxide ($Tl_2O_3$), bismuth oxide ($Bi_2O_3$), manganese dioxide ($MnO_2$), boron trioxide ($B_2O_3$), arsenic oxide ($As_2O_3$), germanium oxide ($GeO_2$), tin oxide ($SnO_2$), silicon dioxide ($SiO_2$), tantalum oxide ($Ta_2O_5$), niobium oxide ($Nb_2O_5$), vanadium oxide ($V_2O_5$), titanium oxide ($TiO_2$), zirconium dioxide ($ZrO_2$), molybdenum oxide ($MoO_3$), silicon nitride ($Si_3N_4$), titanium nitride (TiN), boron nitride (BN) silicon carbide (SiC) and titanium nitride (TiN). Any one of these materials or a mixture of two or more of them can be used.

Typical examples of inorganic compounds having an electronegativity of less than 8.5 are magnesium oxide (MgO), yttrium oxide ($Y_2O_3$), europium oxide ($Eu_2O_3$), neodymium oxide ($Nd_2O_3$), thulium oxide ($Tm_2O_3$), dysprosium oxide ($Dy_2O_3$), lanthanum oxide ($La_2O_3$), cobalt oxide (CoO) and nickel oxide (NiO). Any one of these materials or a mixture of two or more of them can be used.

These inorganic insulating compounds are in a particle form, and each particle size preferably does not exceed 5 μm.

In general, when the particle size is decreased, the surface area per unit weight is increased, and electrostatic energy stored on the surface is increased accordingly and sometimes reaches $10^3$ to $10^4$ times the gravity. According to the present invention, when a maximum particle size of the inorganic compound powder is set to be 5 μm or less, high electrostatic energy is stored in the inorganic compound powder particles, and the inorganic compound can be strongly attracted to the surface of the magnetic powder. Particles having a size of more than 5 μm tend to be detached from the surface of the magnetic powder particles. When such large particles are present, the inorganic compound particles tend to coagulate. As a result, the inorganic compound particles are not uniformly deposited on the surfaces of the magnetic powder particles.

In order to reinforce uniform dispersion of the inorganic compound particles on the surface of the magnetic powder, an organic metal coupling agent such as a titanium-, silicon- or aluminum-based coupling agent may be added when the inorganic compound powder and the magnetic powder are mixed. By adding such a coupling agent, the high-frequency characteristics of magnetic permeability can be improved.

Examples of the coupling agents used in the present invention will be described hereinafter.

(a) Titanium-Based Coupling Agent

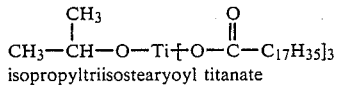

(i)

isopropyltriisostearyoyl titanate

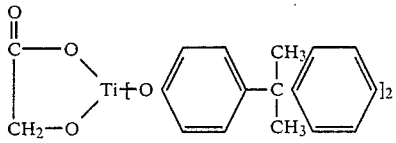

(ii)

dicumylphenyloxyacetate titanate

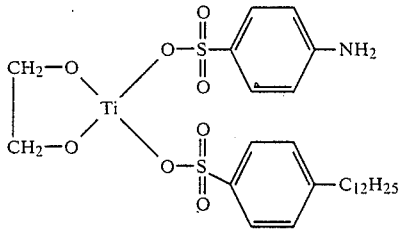

(iii)

-continued 4-aminobenzenesulfonyl dodecylbenzenesulfonyl ethylene titanate (iv)

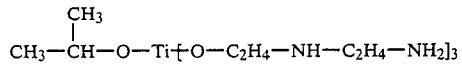

isopropyl tri(N-aminoethyl-aminoethyl)titanate (v)

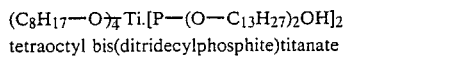

tetraoctyl bis(ditridecylphosphite)titanate (iv)

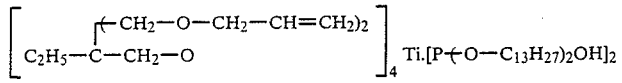

tetra(2,2-diallyloxymethyl-1-butyl)bis(ditridecylphosphite)titanate

The above titanium-based coupling agents are commercially available from, for example, Kenrich Petrochemicals, Inc. U.S.A.

(b) Silicon-Based Coupling Agents (i)

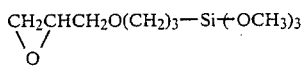

γ-glycidoxypropyl trimethyoxysilane (ii)

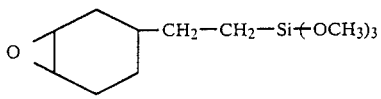

-(3,4-epoxycyclohexyl)ethyltrimethoxysilane (iii)

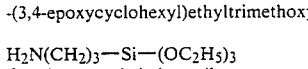

β-aminopropyltriethoxysilane (iv)

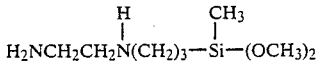

N-β-(aminoethyl)-γ-aminopropyl methyldimethoxysilane

The above silicon-based coupling agents are commercially available from, for example, Union Carbide Corp., U.S.A.

(c) Aluminum-Based Coupling Agent

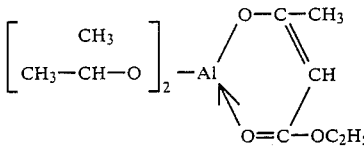

ethylacetoacetatealuminum diisopropylate

In order to deposit the inorganic compound powder onto the magnetic powder, these materials are mixed with a coupling agent as needed. The mixing can be performed in an organic liquid such as alcohol (e.g., ethanol), or may be performed without an organic liquid. The surface of the magnetic particle is charged by friction, so that inorganic compound powder particles having a relatively small size are attracted to the surface of the magnetic particles having a relatively large size, thereby achieving uniform dispersion of the inorganic compound particles. When an inorganic compound powder outside the scope of the present invention is used, the inorganic compound particles are not easily deposited on the surface of the magnetic particles and coagulate. As a result, the magnetic particles are not sufficiently insulated from each other in the resultant core.

In the case where the above-mentioned mixing is performed in the organic solution, the resultant mixture must be dried well to remove the organic solution.

It is preferable that the volume of the inorganic compound powder be 40% or less of the total volume of the magnetic powder and the inorganic compound powder. When the volume ratio exceeds 40%, the magnetic flux density of the resultant core at a magnetizing force of 10,000 A/m is decreased to be less than that (0.4 T) of a ferrite core.

The coupling agent may be added in the amount of 0.05 to 1.5% by weight of the total weight of the final mixture.

Metal Alkoxide or Its Decomposition Product

The particles of the magnetic powder can be properly insulated by using a metal alkoxide in place of the above-mentioned inorganic compound powder. The metal alkoxide has the following general formula:

$$M(OR)_x$$

wherein M is a metal or semi-metal atom, R is an alkyl group, and x is a valence of M).

Almost all metal and semi-metal elements in the Periodic Table constitute metal alkoxides. However, the metal element M used for a metal alkoxide in the present invention should not comprise a radioactive element.

In the above formula, the alkyl group must have at least one carbon atom but can generally have 1 to 5 carbon atoms as exemplified by a methyl group, ethyl group, propyl group, butyl group or pentyl group.

The metal alkoxide in the general formula described above includes, for example, $Si(OCH_3)_4$, $Ti(OC_2H_5)_4$, $In(OC_3H_7)_3$, $Al(OC_4H_9)_3$, $Zr(OC_5H_{11})_4$ or $Ta(OC_3H_7)_5$. Any one of these alkoxides or a mixture of two or more of them may be used.

This metal alkoxide is brought into contact with the metallic magnetic powder, and the metal alkoxide or its decomposition product (e.g., an oxide, hydroxide or hydrate) is formed as a layer on the surface of the metallic magnetic powder.

The metal alkoxide is brought into contact with the metallic magnetic powder to form the deposited layer in the following manner:

(1) The magnetic powder is dipped and stirred in a solution of a metal alkoxide in an organic solvent. The organic solvent is filtered out or evaporated to provide the magnetic powder;

(2) After solution of a metal alkoxide in an organic solvent is sprayed onto the metallic magnetic powder, the powder is dried; or (3) A vapor of a metal alkoxide is brought into contact with the magnetic powder.

The resultant deposited layer comprises the metal alkoxide itself or an oxide or hydroxide produced by decomposition of the metal alkoxide. In general, the metal alkoxide is hydrolysed by moisture adsorbed on the surface of the metallic magnetic power to form a deposited layer of a metal oxide ($MO_{x/2}$) or metal hydroxide ($M(OH)_x$). Alternatively, the deposited layer may comprise a hydrate. Furthermore, a metal alkoxide and a hydroxide of the deposited layer may be oxidized by heating into an oxide. The decomposition products (without heating) of the insulating deposition layer are listed in Table A below:

TABLE A

| Element | Decomposition Product | Element | Decomposition Product |
|---|---|---|---|
| Li | LiOH | Cd | $Cd(OH)_2$ |
| Na | NaOH | Al | AlOOH |
| K | KOH | | $Al(OH)_3$ |
| Be | $Be(OH)_2$ | Ga | GaOOH |
| Mg | $Mg(OH)_2$ | | $Ga(OH)_3$ |
| Ca | $Ca(OH)_2$ | In | $In(OH)_3$ |
| Sr | $Sr(OH)_2$ | Si | $Si(OH)_4$ |
| Ba | $Ba(OH)_2$ | Ge | $GeO_2$ |
| Ti | $TiO_2$ | Sn | $Sn(OH)_4$ |
| Zr | $ZrO_2$ | Pb | $PbO.\frac{1}{3}H_2O$ |
| Nb | $Nb(OH)_5$ | | PbO |
| Ta | $Ta(OH)_5$ | As | $As_2O_3$ |
| Mn | MnOOH | Sb | $Sb_2O_5$ |
| | $Mn(OH)_2$ | Bi | $Bi_2O_3$ |
| | $Mn_3O_4$ | Te | $TeO_2$ |
| Fe | FeOOH | Y | YOOH |
| | $Fe(OH)_2$ | | $Y(OH)_3$ |
| | $Fe(OH)_3$ | La | $La(OH)_3$ |
| | $Fe_3O_4$ | Nd | $Nd(OH)_3$ |
| Co | $Co(OH)_2$ | Sm | $Sm(OH)_3$ |
| Cu | CuO | Eu | $Eu(OH)_3$ |
| Zn | ZnO | Gd | $Gd(OH)_3$ |

The insulating layer of metal alkoxide and/or its decomposition product constitutes a continuous film on the surface of each particle of the magnetic powder.

The thickness of the insulating layer is sufficiently 10 μm or less.

As described above, the magnetic powder having the insulating layer thereon is filled in molds and is compression molded at a pressure of 1,000 MPa or less which can be easily, commercially achieved, thereby obtaining a magnetic core of a desired shape. In order to lower magnetostriction of the core caused by pressure during compression molding, a heat treatment at a temperature of 450° C. to 1,000° C. for 0.5 hour or more is available. In the conventional technique using an interparticle insulating resin, when the heat treatment is performed to lower magnetostriction, the resin is decomposed and degrades its electrical insulation property. According to the present invention, however, such a problem does not occur. With the heat treatment, the coercive force and hysteresis loss can be decreased without degrading the electrical insulation property, thereby decreasing the iron loss.

The present invention will be described in detail by way of examples.

EXAMPLES 1-5

Metallic magnetic powders having compositions in Examples 1 to 5 of Table 1 were mixed with corresponding inorganic compound powders at a weight ratio of 99:1, respectively. Each mixture was sufficiently stirred, and the magnetic powder surface states of the resultant mixtures were observed with an SEM. It was observed that the mixture of Example 1 was uniformly dispersed and attached to the surfaces of the particles as shown in FIG. 1. This satisfactory result is represented by a circle in Table 1.

COMPARATIVE EXAMPLES 1-3

Figure 2:
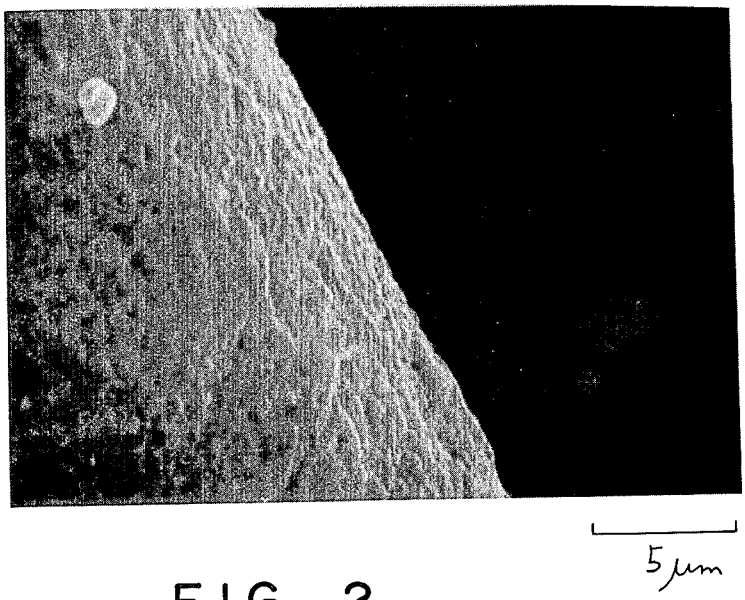
FIG. 2 is a photograph showing a result wherein an insulating inorganic compound fallen outside the present invention is deposited on the surface of each magnetic powder particle.

Metal magnetic powders having compositions departing from the scope of the present invention, as shown in Comparative Examples 1 to 3, were mixed with the corresponding inorganic compound powders in the same manner as in Examples 1 to 5. The resultant mixtures were subjected to SEM observation. Nonuniform deposition of the powder on the surface, as indicated by the SEM photograph of FIG. 2, is represented by a cross in Table 1.

As is apparent from the results of Table 1, the inorganic compound powder of each magnetic core of the present invention was uniformly dispersed and deposited on the surface of the magnetic particle. However, in Comparative Examples 1 to 3, even if a titanium-based coupling agent ("KR-46B" available from Kenrich Petrochemicals, Inc., U.S.A.) was further added to the mixture in an amount of 0.3% by weight, the dispersion property was not greatly improved. The inorganic compound powder was not attached in 70 to 90% of the surface of the magnetic particles. Further, in Comparative Examples 1 to 3, an organic solvent (ethanol) was used when the magnetic powder and the inorganic compound powder were mixed. However, changes did not substantially occur, and no improvement of the deposition efficiency could be observed.

TABLE 1

| | Metal Magnetic | | Inorganic Compound | | | | |
|---|---|---|---|---|---|---|---|
| | Type | Average Particle Size (μm) | Type | Xi | Average Particle Size (μm) | Maximum Particle Size (μm) | Deposition State |
| Example | | | | | | | |
| 1 | Fe-1% Si | 54 | $TiO_2$ | 13.5 | 0.3 | 0.4 | o |
| 2 | Fe-1% Si | 54 | $ZrO_2$ | 12.6 | 1 | 3 | o |
| 3 | Fe-1% Si | 54 | $Y_2O_3$ | 8.4 | 3 | 4.5 | o |
| 4 | Fe | 105 | $Si_3N_4$ | 16.2 | 0.8 | 3 | o |
| 5 | Fe-3% Al | 69 | $TiO_2$ + SiC | 13.5 | 0.3 | 0.4 | o |
| | | | (1:1 wt. ratio) | 16.2 | 0.25 | 1 | |
| Comparative Example | | | | | | | |
| 1 | Fe-1% Si | 54 | $Al_2O_3$ | 10.5 | 0.3 | 1 | x |
| 2 | Fe | 105 | $Si_3N_4$ | 16.2 | 1 | 20 | x |

TABLE 1-continued

| | Metal Magnetic | | Inorganic Compound | | | | |
|---|---|---|---|---|---|---|---|
| | Type | Average Particle Size (μm) | Type | Xi | Average Particle Size (μm) | Maximum Particle Size (μm) | Deposition State |
| 3 | Fe-3% Al | 105 | $MoO_3$ | 23.4 | 6 | 50 | x |

EXAMPLE 6

A mixture was prepared by sufficiently mixing the materials with the composition of Example 1 of Table 1. The mixture, 20 g, was molded at a pressure of 600 MPa to prepare a magnetic core.

A decrease rate of the initial magnetic permeability of the resultant core was measured in a high-frequency range of 10 kHz to 20 kHz and a value obtained at 10 kHz was given as 1. The measured values are plotted as a curve A in the graph of FIG. 3.

The magnetic flux density of the core was 1 T or more at a magnetizing force of 10,000 A/m.

A core prepared by the above method was heat treated in an Ar atmosphere at a temperature of 500° C. for 2 hours, and changes in coercive force and iron loss before and after the test were measured. Results are shown in Table 2.

EXAMPLE 7

A magnetic core was prepared in the same manner as in Examples 1 to 5 except that 0.3% by weight of a titanium-based coupling agent used in comparative Examples was added to the mixture having the composition of Example 1 of Table 1.

Figure 3:
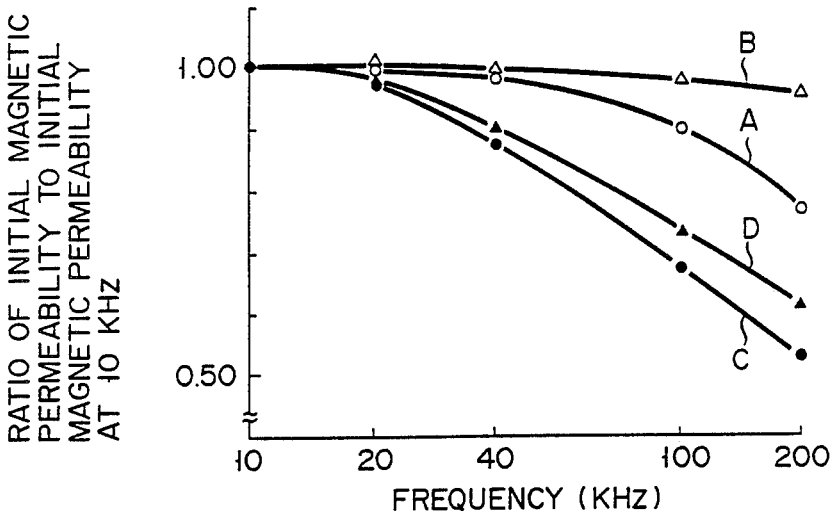
FIGS. 3 and 4 are respectively graphs showing the initial frequency characteristics of permeability of a core of the present invention and those of comparative examples.

Changes in initial magnetic permeability of the resultant core were measured in the same manner as in Example 6, and results are plotted as a curve B of FIG. 3.

The magnetic flux density of the core was 1 T or more at a magnetizing force of 10,000 A/m.

The core was subjected to the heat treatment in the same manner as in Example 6, and changes in coercive force and iron loss before and after the heat treatment were measured. Results are shown in Table 2.

TABLE 2

| | Heat-Treatment | Coercive Force (A/m) | Iron Loss (w/Kg) 50 Hz,1T |
|---|---|---|---|
| Example 6 | Before | 560 | 9.8 |
| | After | 360 | 7.2 |
| Example 7 | Before | 540 | 9.7 |
| | After | 360 | 7.0 |

As is apparent from Table 2, the coercive force of the heat-treated core was confirmed to be decreased. In addition, a decrease in iron loss due to hysteresis loss was also confirmed.

COMPARATIVE EXAMPLE 4

An Fe-1% Si alloy powder (20 grams) having a particle size of 54 μm was compression molded at a pressure of 600 MPa to prepare a core. Changes in initial magnetic permeability of the core were measured in the same manner as in Example 6. Results are plotted as a curve C in the graph of FIG. 3.

COMPARATIVE EXAMPLE 5

A mixture of the Fe-1% Si alloy powder having the composition of Comparative Example 1 of Table 1 and the $Al_2O_3$ powder with an electronegativity of 10.5 was molded at a pressure of 600 MPa to prepare a core. Changes in initial magnetic permeability of the resultant core were measured in the same manner as in Example 6. Results are plotted as a curve D in the graph of FIG. 3.

As is apparent from FIG. 3, decreases in initial magnetic permeabilities of the cores given in Example 6 (curve A) and Example 7 (curve B) in the high-frequency range are smaller than those in Comparative Example 4 (curve C) and Comparative Example 5 (curve D). The interparticle insulation is properly performed by the inorganic compound powder uniformly deposited on the surface.

The characteristics of the core added with the coupling agent in Example 7 (curve B) were confirmed to be better than those in Example 6 (curve A).

The magnetic characteristics of the respective cores of the mixtures having the compositions of Examples 2 to 5 of Table 1 were confirmed to be the same as those of Example 6.

EXAMPLES 8 and 9

An Fe-1.5% Si alloy powder (100 grams) having an average particle size of 54 μm in Example 8 and an Fe-1.5 Si alloy powder (100 grams) having an average particle size of 105 μm in Example 9 were each dipped and stirred in a 15% butyl acetate solution (200 ml) of $Zr(OC_4H_9)_4$. The butyl acetate solution was filtered out, and the resultant alloy powders were dried at a temperature of 20° C. for 2 hours. 20 grams of each of the resultant magnetic powders were respectively filled in molds and were molded at a pressure of 800 MPa, thereby preparing magnetic cores.

EXAMPLE 10

An Fe-3% Al alloy powder (100 grams) having an average particle size of 69 μm was exposed to a $Ti(OC_3H_7)_4$ vapor. In this case, the vapor concentration of $Ti(OC_3H_7)_4$ was 2,000 ppm at a temperature of 200° C. 20 grams of the resultant magnetic powder was used to prepare a core in the same manner as in Examples 8 and 9.

COMPARATIVE EXAMPLES 6 and 7

An Fe-1.5% Si alloy powder (20 grams) having an average particle size of 54 μm in Comparative Example 6 and an Fe-3% Al alloy powder (20 grams) having an average particle size of 69 μm were respectively filled in the molds and were molded at a pressure of 800 MPa to prepare magnetic cores.

Figure 4:
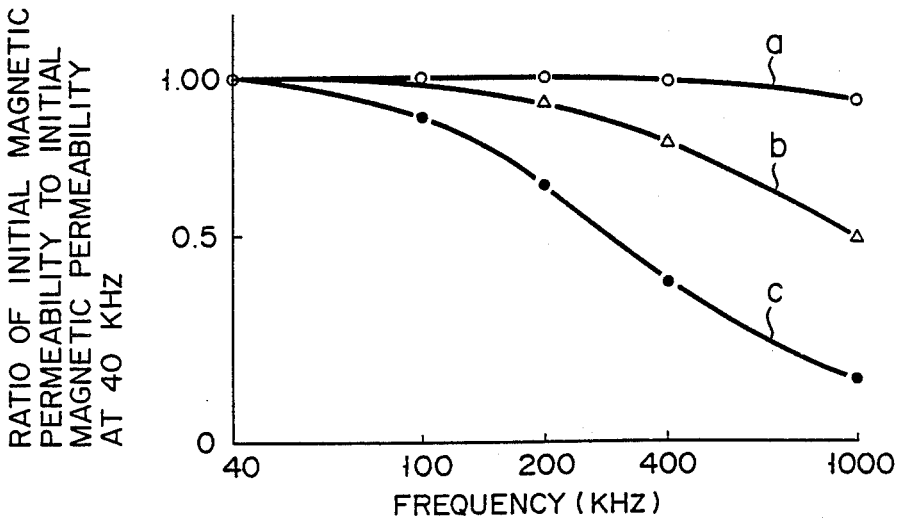

The above cores had a high magnetic flux density of 0.8 T or more at a magnetizing force of 10,000 A/m. The frequency characteristics of the initial magnetic permeabilities of these cores were measured. Results are shown in FIG. 4. Referring to FIG. 4, initial magnetic permeability ratios are represented by the initial magnetic permeability at 40 kHz given as 1. Curve a represents the initial permeability ratio in Example 8; b, in Example 9; and c, Comparative Example 6. As is apparent from FIG. 4, the initial magnetic permeability of the core of Example 8 was not substantially degraded up to 1 MHz, and the initial magnetic permeability of the core of Example 10 was not substantially degraded up to 200 kHz. However, the initial magnetic permeability of the core of Comparative Example 6 was greatly degraded starting from 100 kHz. The frequency characteristics of the core of Example 10 were substantially the same as those of Example 8. The initial magnetic permeability of the core of Comparative Example 7 was greatly degraded.

The core of Example 8 was heat treated in an Ar atmosphere at a temperature of 500° C. for 2 hours. The coercive force of the core prior to the heat treatment was 480 A/m, but was decreased to 280 A/m after the heat treatment. Therefore, the iron loss in the high-frequency range was decreased to less than 65%.

In the compressed magnetic powder core according to the present invention as described above, since the surface of each particle of the magnetic powder constituting the powder core is effectively covered with an insulating layer of an inorganic compound having a specific electronegativity, a metal alkoxide, or its decomposition product, a high magnetic density can be provided and at the same time the eddy current loss can be decreased, thereby achieving a high magnetic permeability up to a high-frequency range. In addition, the core of the present invention can be heat treated at a high temperature, and the hysteresis loss can be decreased. As a result, the iron loss can be decreased.

What is claimed is:

1. A compressed magnetic powder core comprising a compressed body of an iron-based metallic magnetic powder having an average particle size of not less than 10 μm and not more than 300 μm, each particle surface of said metallic powder having been covered with an insulating layer consisting of a material which is a decomposition product of a metal alkoxide selected from the group consisting of alkoxides of lithium, sodium, potassium, beryllium, magnesium, calcium, strontium, barium, titanium, zirconium, niobium, tantalum, manganese, iron, cobalt, copper, zinc, cadmium, aluminum, gallium, indium, silicon, germanium, tin, lead, arsenic, bismuth, tellurium, yttrium, lanthanum, neodymium, samarium, europium and gadolinium, and a mixture thereof, and is a corresponding metal hydroxide, said insulating layer having a thickness of not more than 10 μm.

2. A compressed magnetic powder core comprising a compressed body of an iron-based metallic magnetic powder having an average particle size of not less than 10 μm and not more than 300 μm each particle surface of said metallic powder having been covered with an insulating layer consisting of a material which is a decomposition product of a metal alkoxide selected from the group consisting of alkoxides of lithium, sodium, potassium, beryllium, magnesium, calcium, strontium, barium, titanium, zirconium, niobium, tantalum, manganese, iron, cobalt, copper, zinc, cadmium, aluminum, gallium, indium, silicon, germanium, tin, lead, arsenic, bismuth, tellurium, yttrium, lanthanum, neodymium, samarium, europium and gadolinium, and a mixture thereof, and is a corresponding metal oxyhydroxide, said insulating layer having a thickness of not more than 10 μm.

3. A compressed magnetic powder core comprising a compressed body of an iron-based metallic magnetic powder having an average particle size of not less than 10 μm and not more than 300 μm each particle surface of said metallic powder having been covered with an insulating layer consisting of a material which is a metal alkoxide and is selected from the group consisting of alkoxides of lithium, sodium, potassium, beryllium, calcium, strontium, barium, titanium, zirconium, niobium, tantalum, manganese, iron, cobalt, copper, zinc, cadmium, aluminum, gallium, indium, silicon, germanium, tin, lead, arsenic, bismuth, tellurium, yttrium, lanthanum, neodymium, samarium, europium and gadolinium, and a mixture thereof, said insulating layer having a thickness of not more than 10 μm.

* * * * *